US008251637B2

(12) United States Patent
Lewis et al.

(10) Patent No.: US 8,251,637 B2
(45) Date of Patent: Aug. 28, 2012

(54) SYSTEMS AND METHODS FOR MODIFYING MODAL VIBRATION ASSOCIATED WITH A TURBINE

(75) Inventors: Bryan Lewis, Mauldin, SC (US); Sayed Murtuza Ahmed, Amravati (IN)

(73) Assignee: General Electric Company, Schenectady, NY (US)

( * ) Notice: Subject to any disclaimer, the term of this patent is extended or adjusted under 35 U.S.C. 154(b) by 1012 days.

(21) Appl. No.: 12/122,071

(22) Filed: May 16, 2008

(65) Prior Publication Data

US 2009/0285675 A1 Nov. 19, 2009

(51) Int. Cl.
*F01D 25/04* (2006.01)

(52) U.S. Cl. ..... 415/1; 415/173.1

(58) Field of Classification Search ..... 415/115, 415/116, 173.1, 1

See application file for complete search history.

(56) References Cited

U.S. PATENT DOCUMENTS

| | | | | |
|---|---|---|---|---|
| 6,126,389 | A * | 10/2000 | Burdgick | 415/115 |
| 6,302,642 | B1 * | 10/2001 | Nagler et al. | 415/116 |
| 6,409,465 | B1 * | 6/2002 | von Flotow et al. | 415/1 |
| 6,508,623 | B1 * | 1/2003 | Shiozaki et al. | 415/173.1 |
| 6,602,048 | B2 * | 8/2003 | Fujikawa et al. | 415/116 |
| 7,033,138 | B2 * | 4/2006 | Tomita et al. | 415/139 |
| 7,665,962 | B1 * | 2/2010 | Liang | 415/173.1 |

* cited by examiner

*Primary Examiner* — Edward Look
*Assistant Examiner* — Liam McDowell
(74) *Attorney, Agent, or Firm* — Sutherland Asbill & Brennan LLP

(57) ABSTRACT

Shroud assemblies and methods for modifying modal vibrations associated with a turbine are described. A shroud assembly includes an inner shroud and an outer shroud. The inner shroud includes a body with a first end portion, a second end portion opposite to the first end portion, an upper surface and a lower surface, wherein the lower surface is adjacent to a plurality of rotating turbine blades. The inner shroud further includes at least two rails formed on the upper surface and extending between the first end portion and the second end portion, wherein an impingement cooling area is defined between the at least two rails. Additionally, the inner shroud includes at least one cross-member formed on the upper surface in a direction transverse to the at least two rails.

8 Claims, 12 Drawing Sheets

SYSTEMS AND METHODS FOR MODIFYING MODAL VIBRATION ASSOCIATED WITH A TURBINE

FIELD OF THE INVENTION

This invention relates generally to turbines and more specifically, to modifying modal vibrations associated with a turbine.

BACKGROUND OF THE INVENTION

Turbines are used in a variety of aviation, industrial and power generation applications. Typically, gas turbines operating under relatively high pressure and relatively high temperature conditions, include a plurality of rotating turbine blades extending from a rotor. These turbine blades may be driven by one or more hot gases. Any leakage of the hot gas around one or more of the rotating turbine blade tips may reduce the efficiency of the turbine. Thus, the turbine is typically provided with a shroud assembly to minimize a significant leakage of the hot gas. The shroud assembly is typically fixed to a turbine casing and covers the rotating turbine blades. In this regard, the shroud assembly typically provides a circumferential covering to the rotating turbine blades. The gas turbines that include shroud assemblies may provide the advantage of minimum hot gas leakage and, therefore, improve the turbine efficiency.

Conventionally, the shroud assembly of a turbine has an outer shroud and a plurality of inner shrouds. The outer shroud is typically secured to the turbine casing or shell. A typical inner shroud may include an upper surface, a lower surface, a first (forward) end portion and a second (aft) end portion. The lower surface of the inner shroud is typically placed adjacent to the rotating turbine blades. The use of the shroud assembly in the turbine may prevent or minimize the leakage of hot gases into the secondary flow path and may reduce the vibration of the blade tip for each of the rotating turbine blades. Additionally, as each of the plurality of inner shrouds is continuously in contact with the hot gas, the upper surface of each of the inner shrouds is typically covered with an impingement cooling plate for cooling each of the inner shrouds.

Under typical operating and load conditions, the plurality of rotating turbine blades rotate with a fixed number of revolutions per minute. The rotation of the plurality of turbine blades typically causes excitation and vibration of one or more of the plurality of rotating turbine blades with an excitation frequency. Besides, the inner shroud has a harmonic frequency and a plurality of modal vibration frequencies of vibration. The harmonic frequency and the plurality of modal vibration frequencies of the inner shroud are typically a function of its mass and design or structural features, for example, the thickness of a plurality of rails extending between the first end portion and the second end portion or the thickness of the impingement cooling area. A concern arises when at least one of the modal vibration frequencies of the inner shroud lies close to the excitation frequency of one or more of the rotating turbine blades. Such a situation may result in resonance or modal excitation in the inner shroud. This resonance may cause the seal that separates the secondary flow path from the hot gas path to crack, leading to a leakage of the hot gas to the secondary flow path, and thereby reducing the efficiency of the turbine. Additionally, hot gas path (HGP) ingestion may occur and reduce the cooling to the outer shroud. Thus, the temperature of the outer shroud may also increase, increasing the risk of structural damage to the outer shroud. The leakage of the hot gas may, therefore, reduce the life cycle of the shroud assembly and increase the maintenance and repair cost associated with the shroud assembly. Additionally, the leakage of the hot gas may adversely affect the performance of the turbine.

Accordingly, there is a need for an improved inner turbine shroud design that assists in modifying the vibration within the inner turbine shroud.

BRIEF DESCRIPTION OF THE INVENTION

According to one embodiment of the invention, there is disclosed a shroud assembly for a turbine that includes an inner shroud and an outer shroud. The inner shroud includes a body with a first end portion, a second end portion opposite to the first end portion, an upper surface and a lower surface, wherein the lower surface is adjacent to a plurality of rotating turbine blades. The inner shroud further includes at least two rails formed on the upper surface and extending between the first end portion and the second end portion, wherein an impingement cooling area is defined between the at least two rails. Additionally, the inner shroud includes at least one cross-member formed on the upper surface in a direction transverse to the at least two rails.

According to another embodiment of the invention, there is disclosed a turbine. The turbine includes a turbine casing, a rotor, a plurality of rotating turbine blades extending from the rotor, and a shroud assembly. The shroud assembly includes an outer shroud mounted to the turbine cases and a plurality of inner shrouds. Each of the plurality of inner shrouds includes one or more mountings that facilitate a connection between the inner shroud and the outer shroud of the shroud assembly. Additionally, each of the plurality of inner shrouds includes a body with a first end portion, a second end portion opposite to the first end portion, an upper surface, and a lower surface, wherein the lower surface is adjacent to the plurality of rotating turbine blades. At least two rails are formed on the upper surface and extending between the first end portion and the second end portion, and at least one cross-member is formed on the upper surface in a direction transverse to the at least two rails.

According to yet another embodiment of the invention, there is disclosed a method for modifying at least one modal vibration frequency of an inner shroud of a shroud assembly in a turbine. A body of the inner shroud is provided. The body includes a first end portion, a second end portion, an upper surface, and a lower surface, wherein the lower surface is adjacent to a plurality of rotating turbine blades associated with the turbine. At least two rails are provided that extend between the first end portion and the second end portion along a length of the body, wherein the at least two rails define an impingement cooling area on the upper surface and between the at least two rails. At least one cross-member is provided on the upper surface in a direction transverse to the at least two rails.

Other embodiments, aspects, features, and advantages of the invention will become apparent to those skilled in the art from the following detailed description, the accompanying drawings, and the appended claims.

BRIEF DESCRIPTION OF THE DRAWINGS

Figure 1:
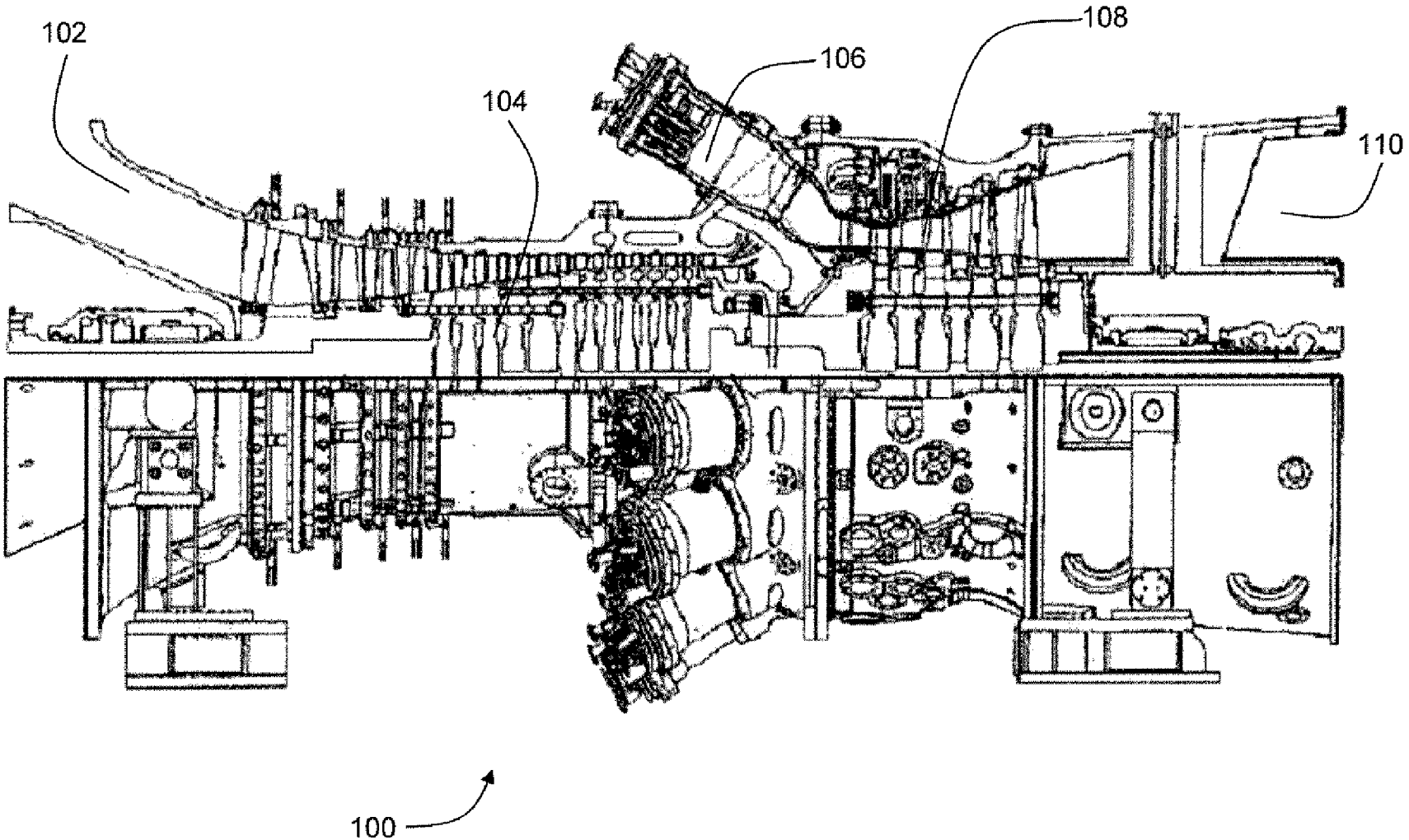
FIG. 1 [ Prior Art ]

Having thus described the invention in general terms, reference will now be made to the accompanying drawings, which are not necessarily drawn to scale, and wherein:

FIG. 1 is a cross-sectional view of one example of a gas turbine in which embodiments of the invention may be utilized.

Figure 2:
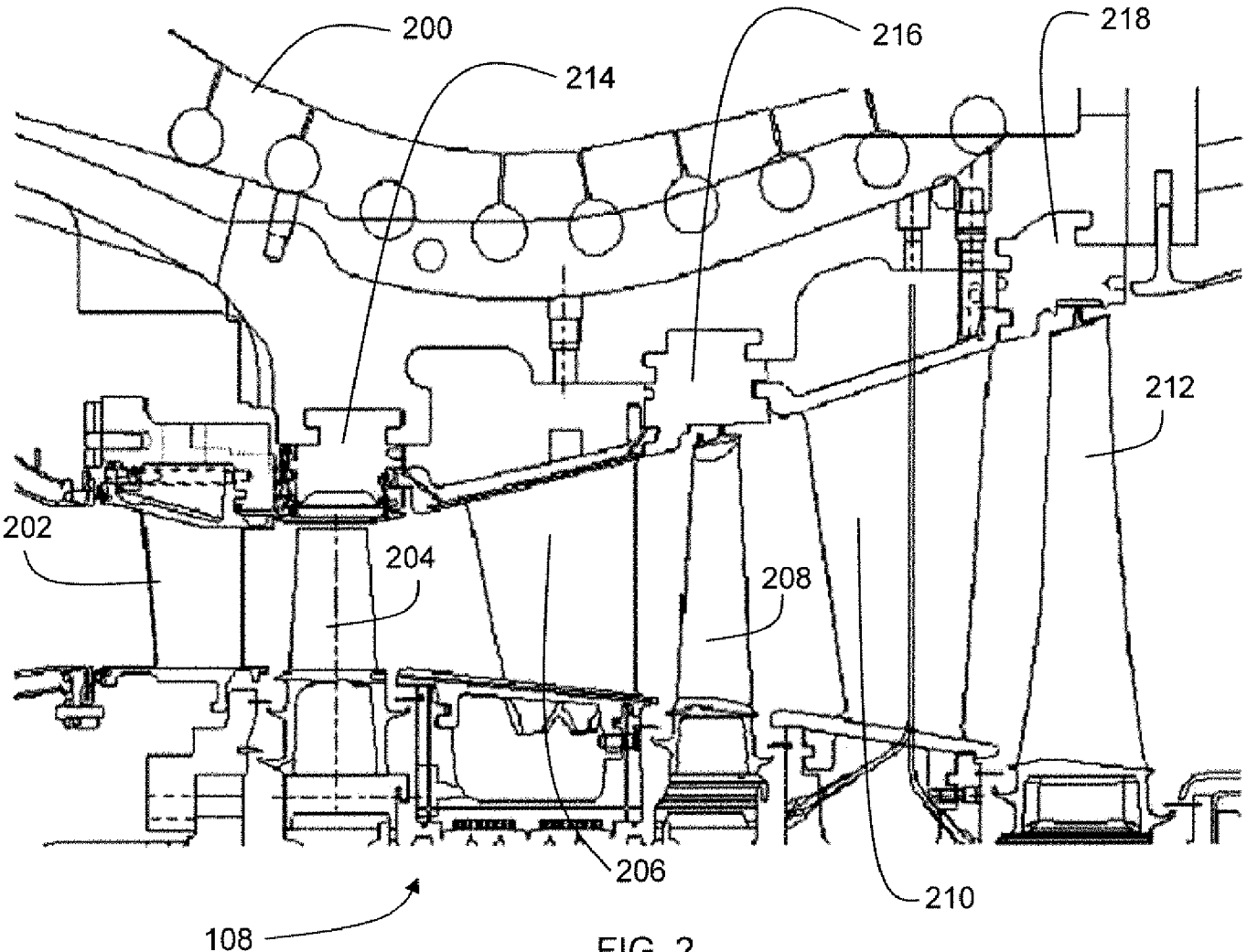
FIG. 2 [ Prior Art ]

FIG. 2 is a cross-sectional view of a portion of the gas turbine shown in FIG. 1, within which embodiments of the invention may be utilized.

Figure 3:
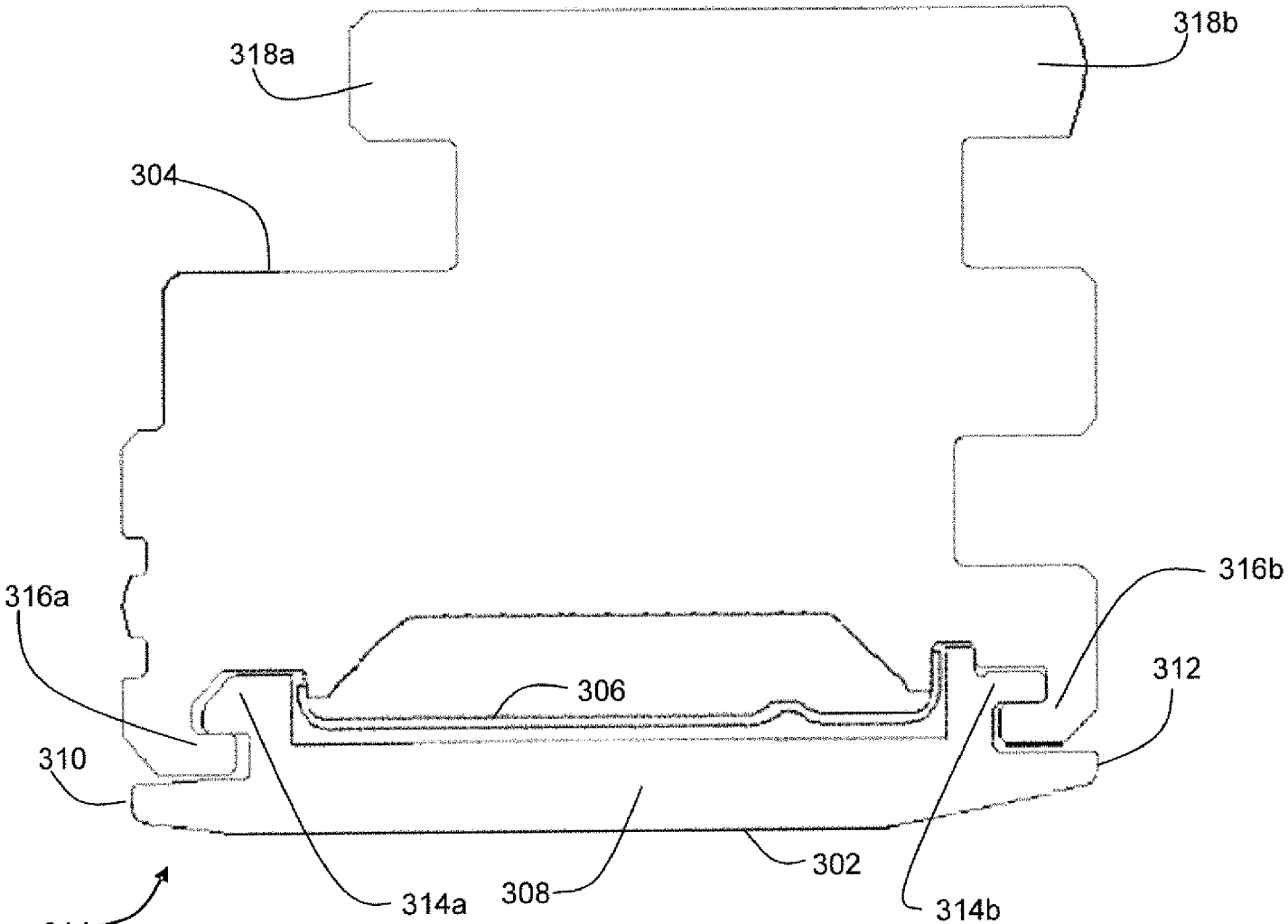

FIG. 3 is a cross-sectional view of one example of a turbine shroud in which embodiments of the invention may be utilized.

Figure 4:
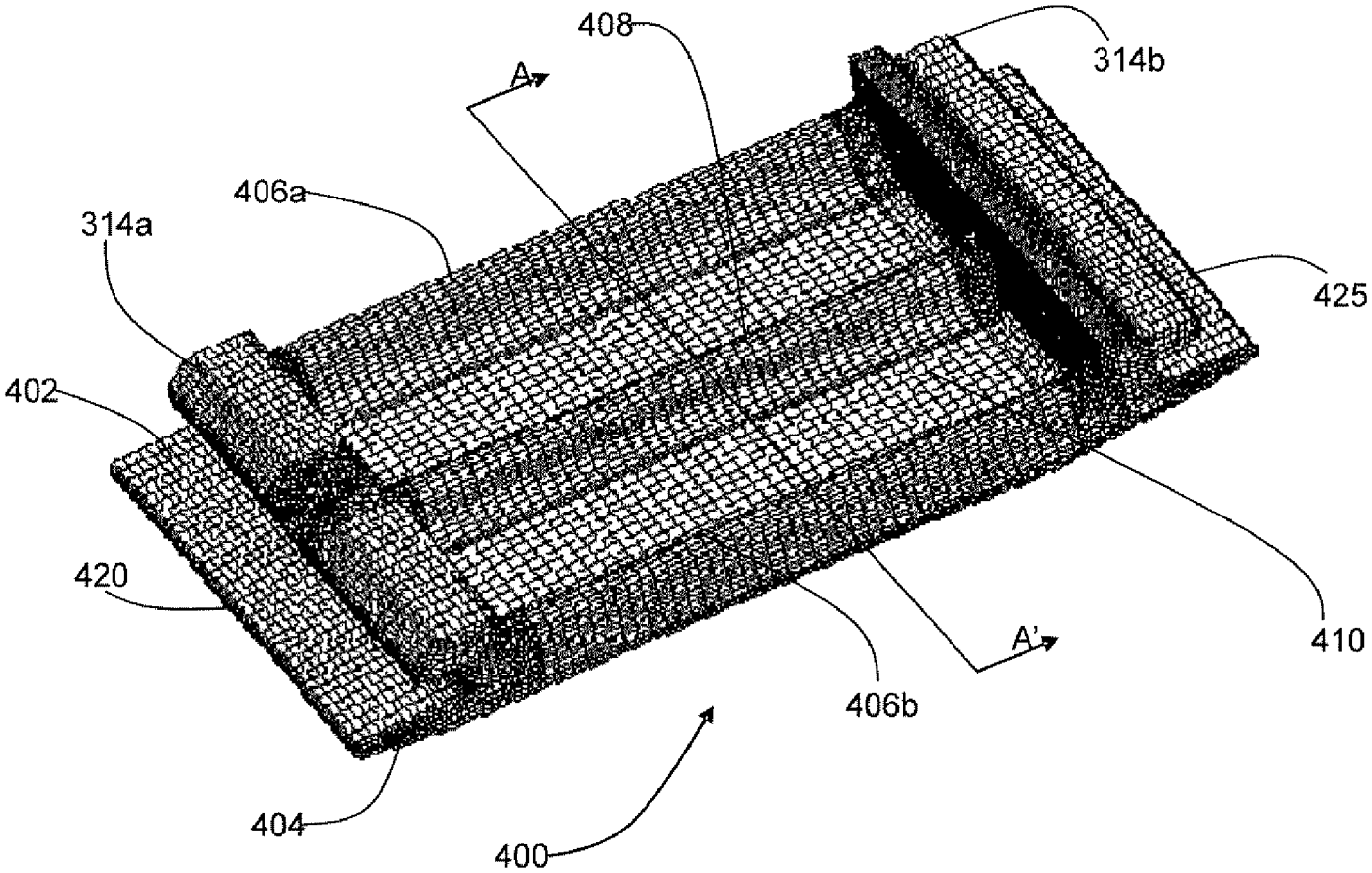
FIG. 4 [ Prior Art ]

FIG. 4 is a schematic perspective view of a conventional inner shroud for use in a turbine shroud assembly.

Figure 5:
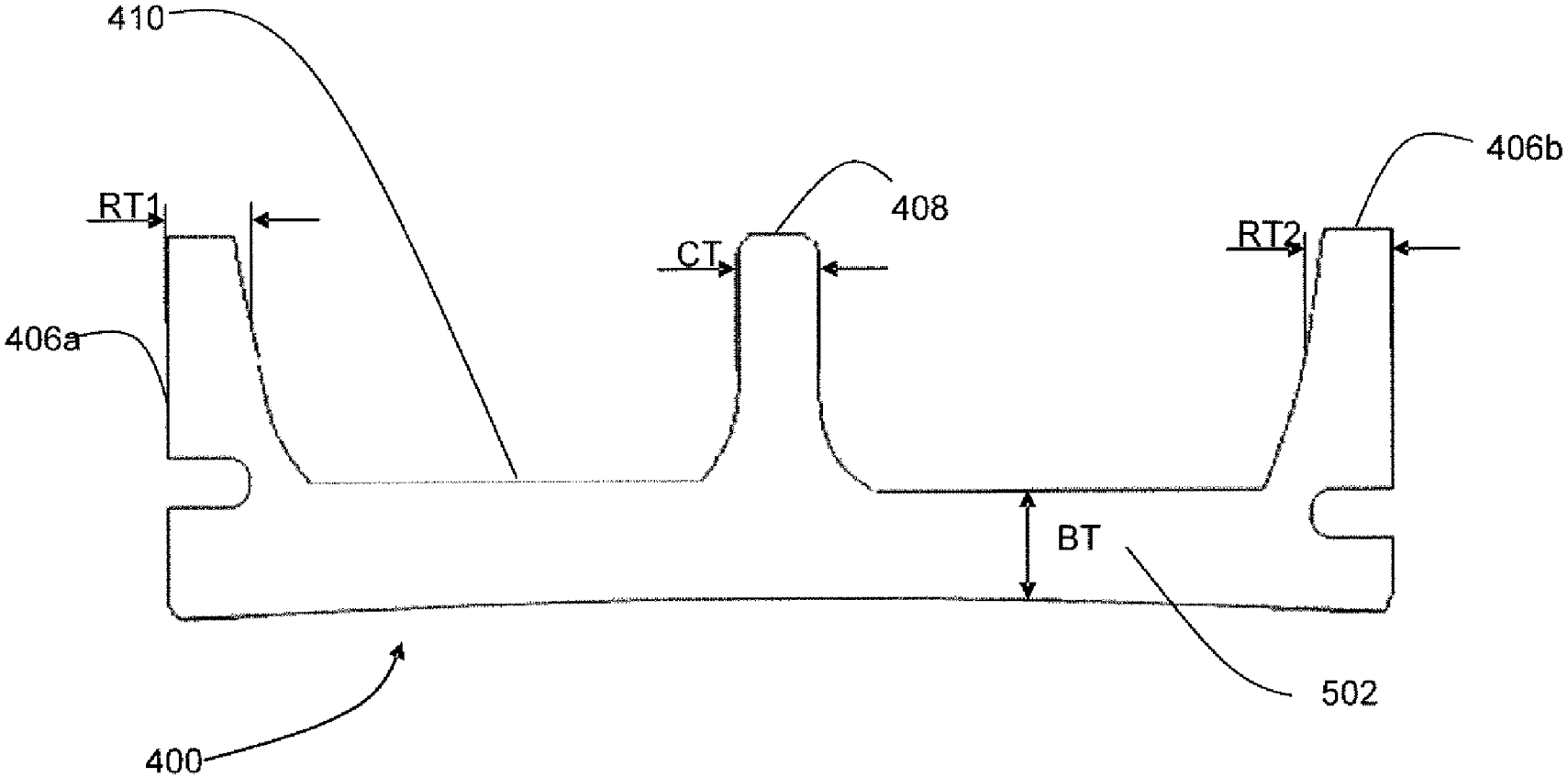
FIG. 5 [ Prior Art ]

FIG. 5 is a cross-sectional view taken along line A-A' of the conventional inner shroud shown in FIG. 4.

Figure 6:
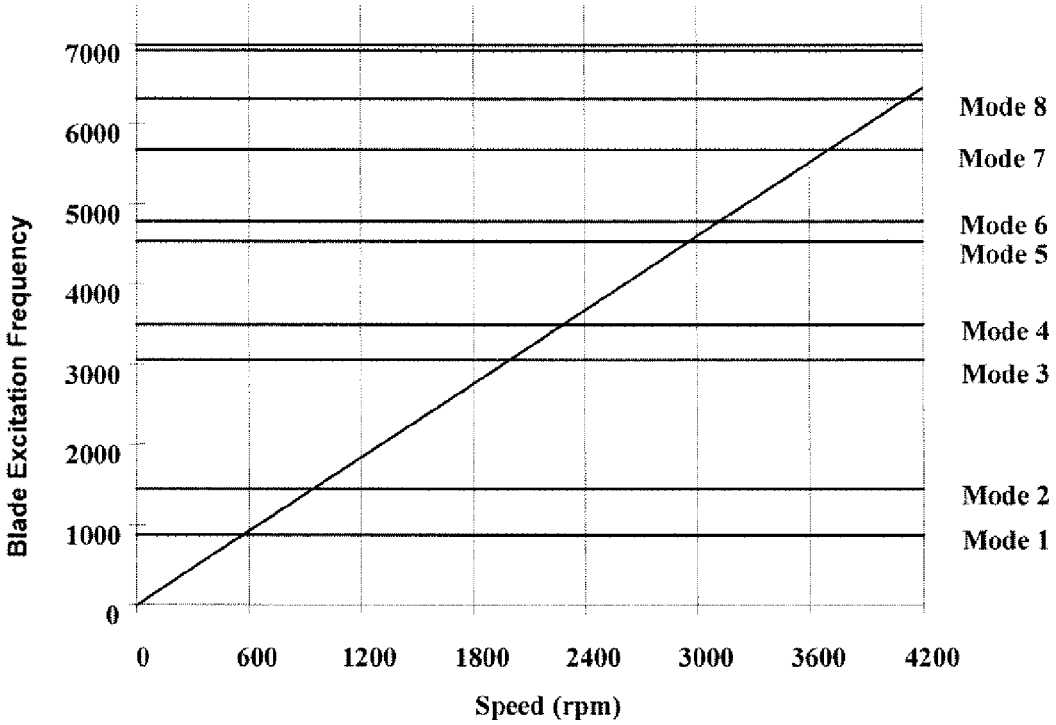
FIG. 6 [ Prior Art ]

FIG. 6 is a Campbell Diagram for the conventional inner shroud shown in FIG. 4.

Figure 7:
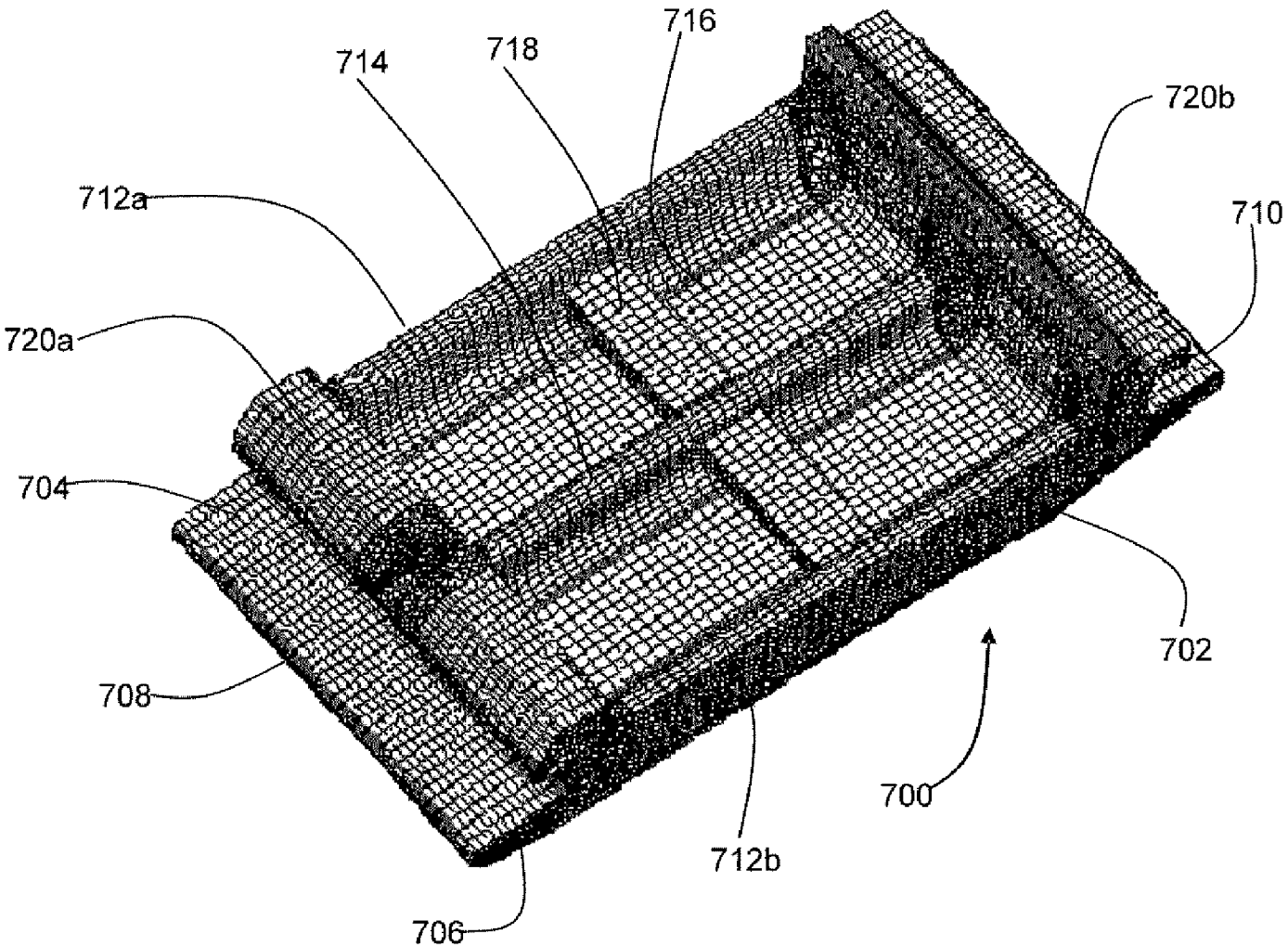

FIG. 7 is a schematic perspective view of one example of an inner shroud in accordance with an illustrative embodiment of the invention.

Figure 8A:
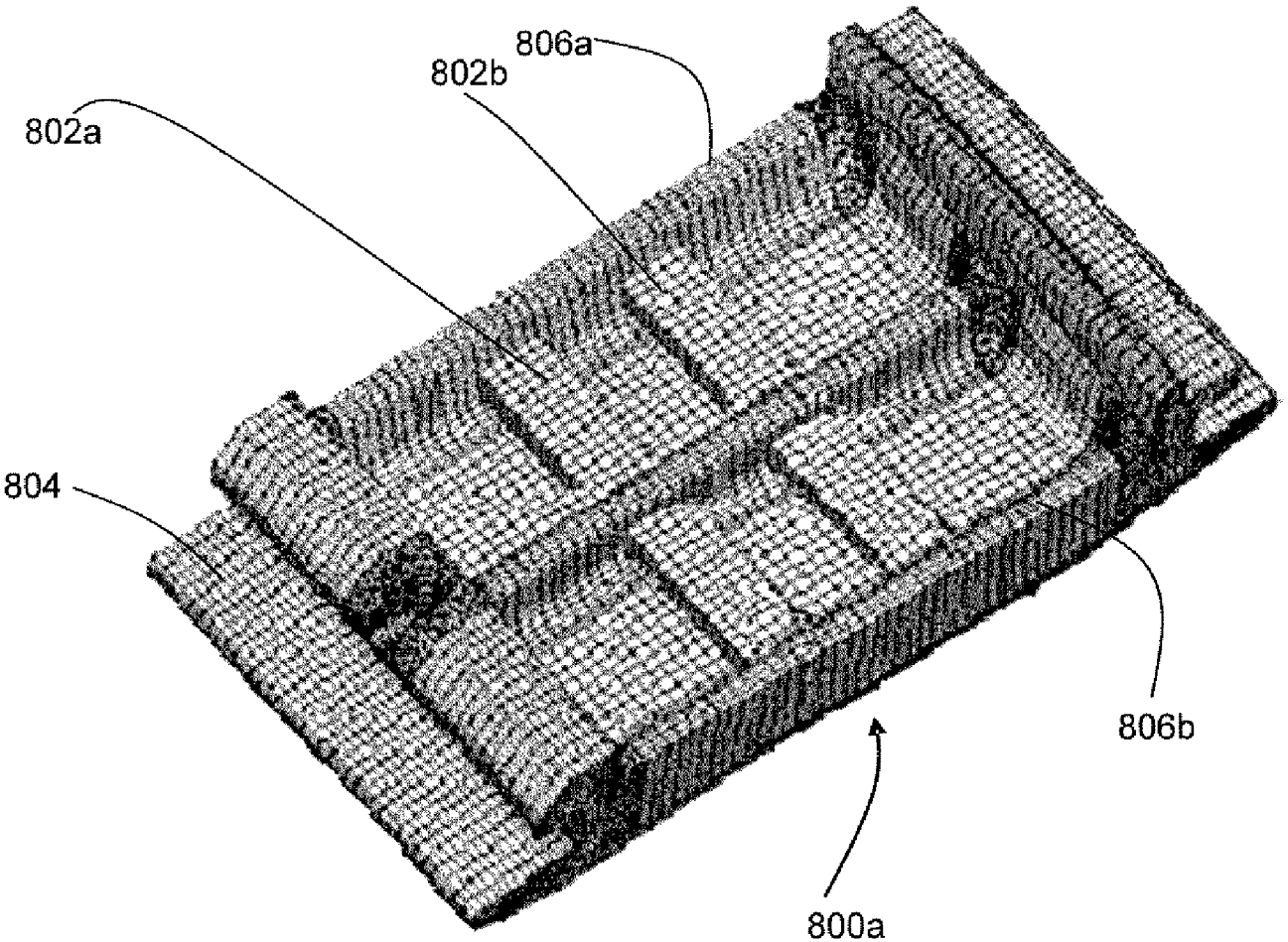

FIG. 8A is a perspective view of another example of an inner shroud in accordance with an illustrative embodiment of the invention.

Figure 8B:
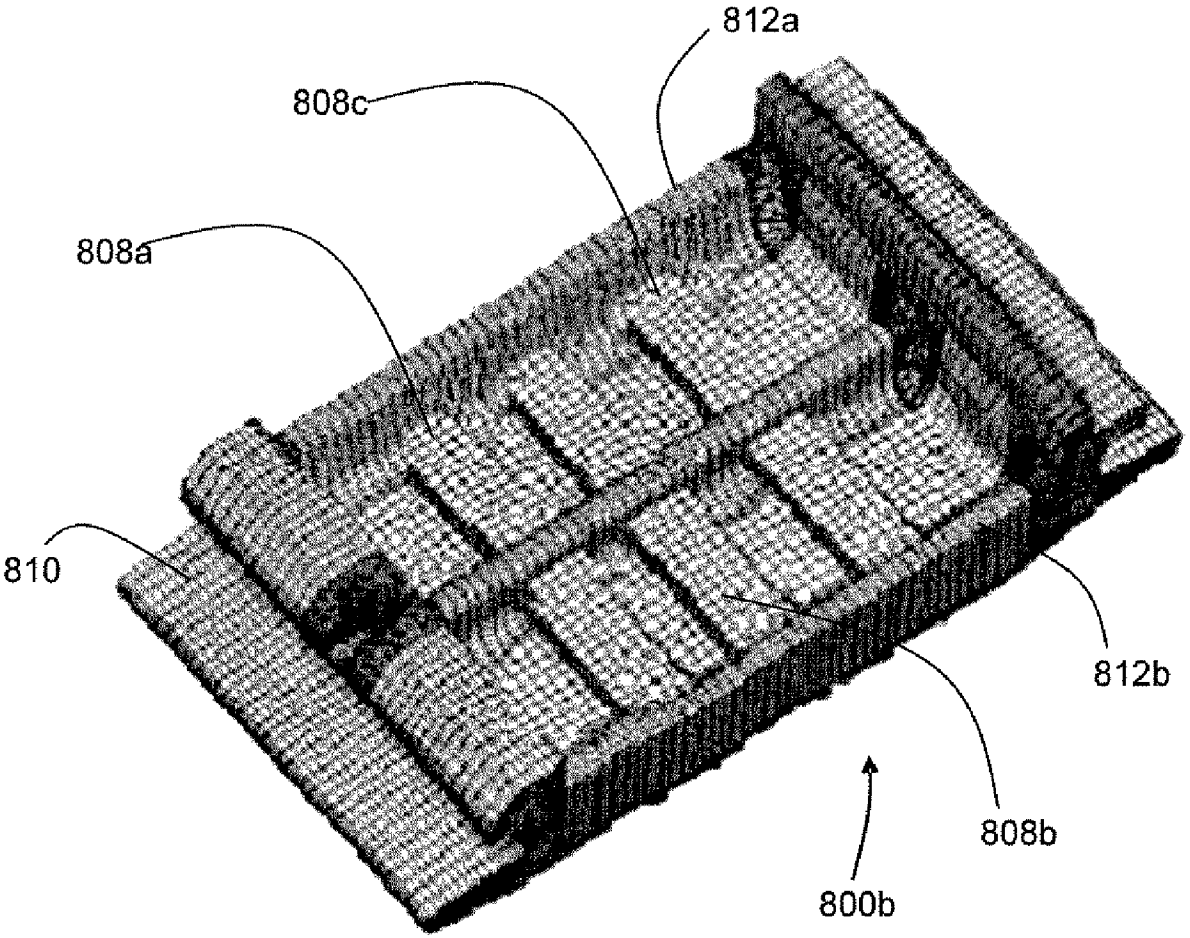

FIG. 8B is a perspective view of another example of an inner shroud in accordance with an illustrative embodiment of the invention.

Figure 9:
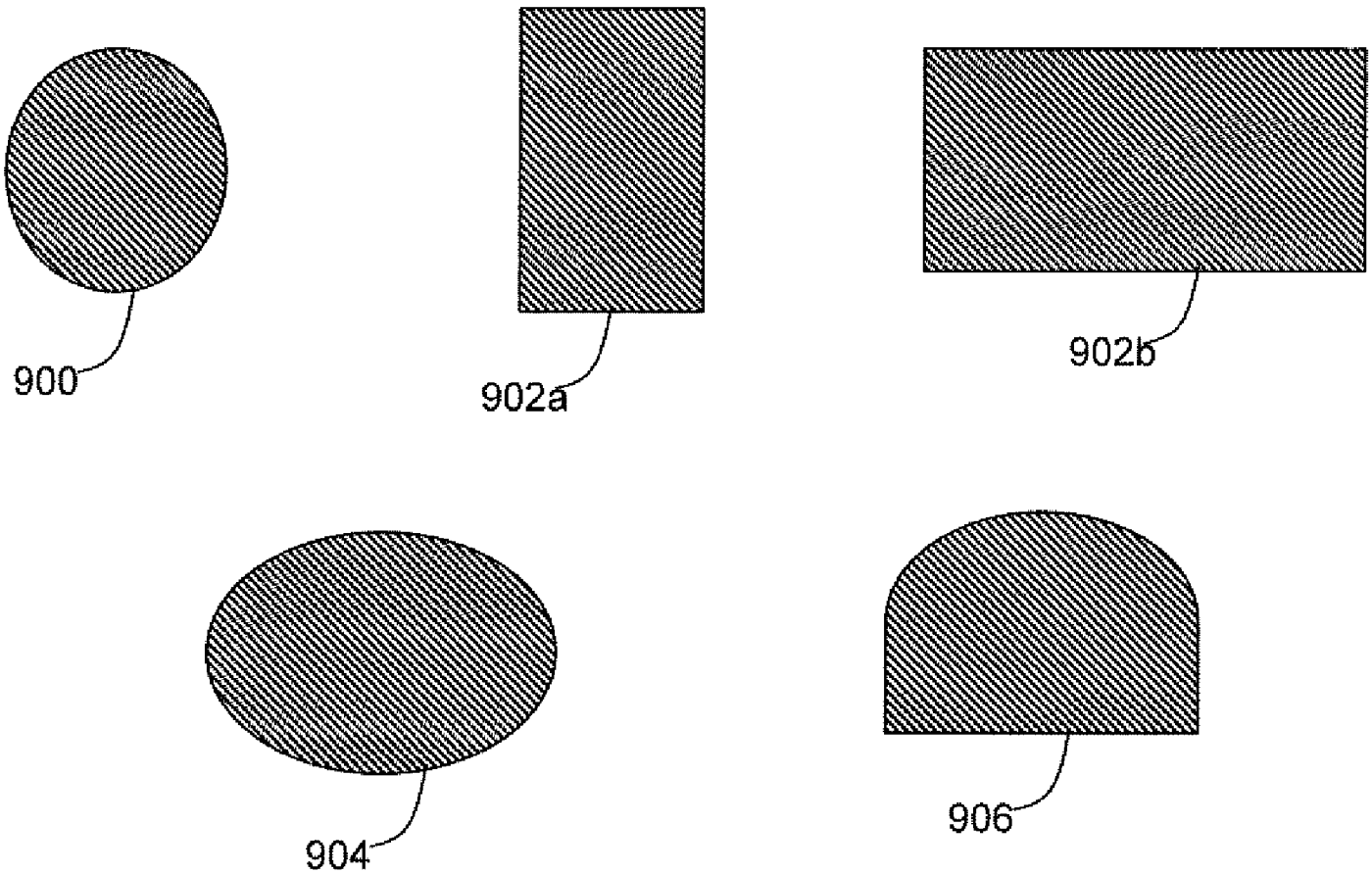

FIG. 9 illustrates examples of various types of ribs that may be utilized as cross-members in an inner shroud, according to various illustrative embodiments of the invention.

Figure 10:
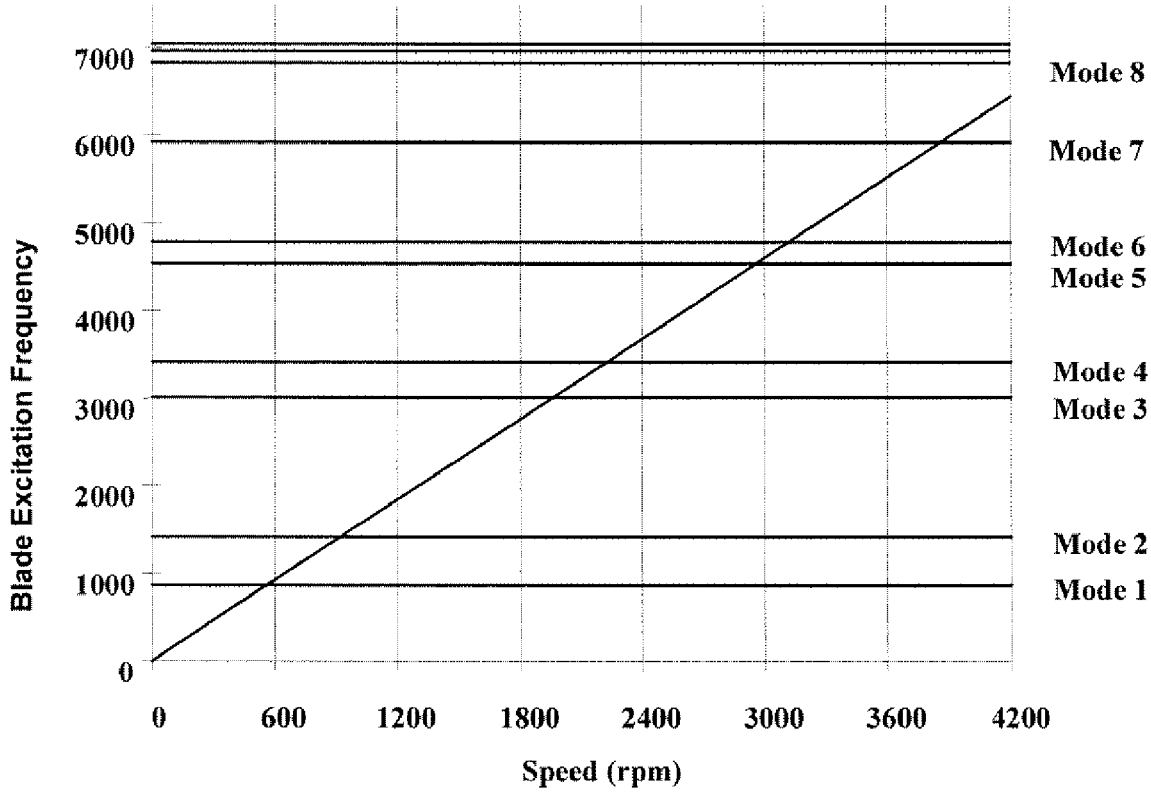

FIG. 10 is one example of a Campbell Diagram for the inner shroud of FIG. 7, according to an illustrative embodiment of the invention.

Figure 11:
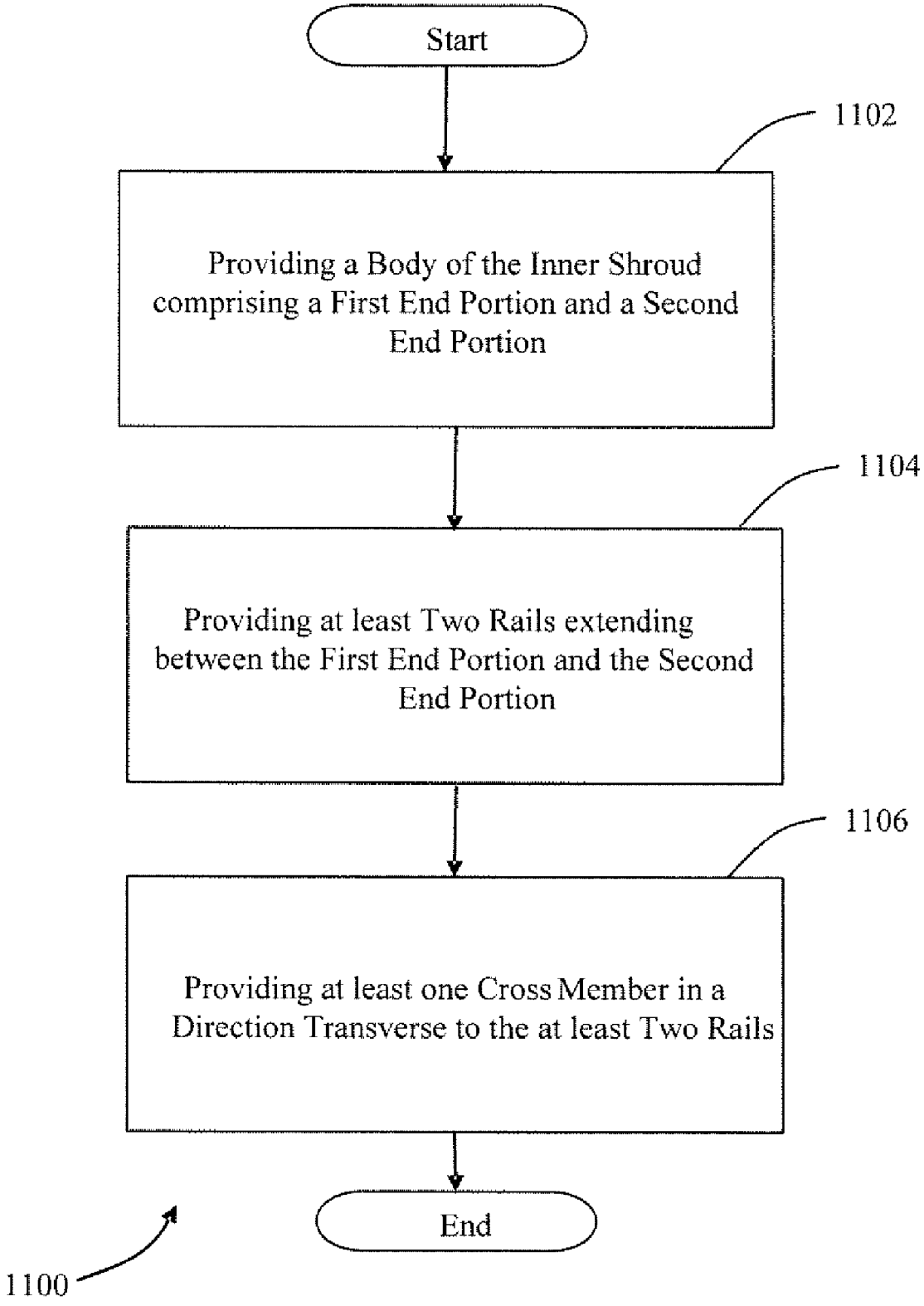

FIG. 11 is a flowchart of one example of a method for making an inner shroud, according to an illustrative embodiment of the invention.

DETAILED DESCRIPTION OF THE INVENTION

Illustrative embodiments of the invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Disclosed are embodiments of inner turbine shrouds and methods for manufacturing inner turbine shrouds in order to modify at least one modal vibration frequency of the inner shroud. One or more cross-members may be included in an inner shroud, and the one or more provided cross-members may facilitate the modification or shifting of at least one modal vibration frequency of the inner shroud away from an excitation frequency of one or more rotating turbine blades associated with a turbine.

FIG. 1 illustrates a cross-sectional view of one example of a gas turbine 100 in which embodiments of the invention may be utilized. Although a gas turbine 100 is illustrated in FIG. 1, embodiments of the invention may be utilized in a wide variety of different turbine designs and turbine types including, but not limited to, turbines utilized for various aviation, industrial, and/or power generation applications.

With reference to FIG. 1, the illustrated gas turbine 100 may include an intake section 102, a compressor section 104, a combustor section 106, a turbine section 108, and an exhaust section 110. In general operation, air may enter through the intake section 102 and may be compressed to a predefined or predetermined pressure in the compressor section 104. At least a portion of the compressed air from the compressor section 104 may be supplied to the combustion section 106. In the combustion section 106, the compressed air may be mixed with a fuel and then the combined air and fuel mixture may be combusted. The combustion of the air and fuel mixture in the combustion section 106 may produce hot gases having a relatively high temperature and a relatively high pressure. The hot gases coming out of the combustion section 106 may be expanded in the turbine section 108 of the gas turbine 100. Following the expansion of the hot gases in the turbine section 108, relatively low pressure hot gases may be sent out from the gas turbine 100 through the exhaust section 110. The relatively low pressure hot gases coming out from the exhaust section 110 may be sent out to the atmosphere, to a combined cycle regeneration plant, and/or to a recirculation duct of a heat exchanger.

In certain embodiments of the invention, the utilized gas turbine, such as gas turbine 100, may have a pressure ratio of approximately 17.5 to approximately 18.5 in the compressor section 104 and a firing temperature ($T_{fire}$) that is greater than approximately 2390° F. Depending on the type of turbine, uses of the turbine, application requirements, and/or operating parameters, the gas turbine 100 may have a wide variety of different pressure ratios and/or firing temperatures.

FIG. 2 is a cross-sectional view of a portion of a gas turbine, such as the turbine 100 shown in FIG. 1. FIG. 2 illustrates a magnified cross-sectional view of one example of the placement and location of various shroud assemblies in the turbine section 108 of the gas turbine 100. The turbine section 108 may include a turbine casing 200 and a plurality of first stage nozzles, such as nozzle 202. The turbine section 108 may further include any number of expansion stages, such as three expansion stages. Each of the expansion stages may include a corresponding set of rotating turbine blades. For example, a first plurality of rotating turbine blades 204 may be included in the first expansion stage, a second plurality of rotating turbine blades 208 may be included in the second expansion stage, and a third plurality of rotating turbine blades 212 may be included in the third expansion stage of the gas turbine 100. The pluralities of rotating turbine blades 204, 208 and 212 may be supported on a rotor (not shown in figure) of the gas turbine 100. The second plurality of rotating turbine blades 208 and the third plurality of rotating turbine blades 212 may be preceded by a plurality of second stage nozzles 206 and a plurality of third stage nozzles 210 respectively. A first stage shroud assembly 214 may be located adjacent to the first plurality of rotating turbine blades 204. Similarly, a second stage shroud assembly 216 and a third stage shroud assembly 218 may be located adjacent to the second and third plurality of rotating turbine blades 208 and 212 respectively. The first stage shroud assembly 214 may define a path for one or more hot gases coming from the combustion section 104 (shown in FIG. 1) of the gas turbine 100 and entering through the plurality of first stage nozzles 202. The one or more hot gases coming through the plurality of first stage nozzles 202 may rotate the plurality of rotating turbine blades 204. After the first expansion stage of the gas turbine 100, the one or more hot gases may be directed to the second plurality of rotating turbine blades 208 through the plurality of second stage nozzles 206 for the second expansion stage of the gas turbine 100 and rotate the second plurality of rotating turbine blades 208. Finally, the one or more hot gases may be directed to the third plurality of the rotating turbine blades 212 through the plurality of third stage nozzles 210 for the third expansion stage of the gas turbine 100 and then directed to the exhaust section 110 of the gas turbine 100. The rotation of the plurality of the rotating turbine blades 204, 208 and 212 may produce a work output through the rotor of the gas turbine 100. Although the gas turbine 100 is shown with three stages of expansion, various other turbines may include any number of expansion stages and shroud assemblies.

FIG. 3 is a cross-sectional view of one example of a turbine shroud in which embodiments of the invention may be utilized. FIG. 3 illustrates a cross-sectional view of a first stage shroud assembly of a gas turbine, such as shroud assembly 214 illustrated in FIG. 2. Similar shroud assemblies may be used in various other turbines. The first stage shroud assembly 214 may include an inner shroud 302 and an outer shroud 304. An impingement plate 306 may be located or situated in between the inner shroud 302 and outer shroud 304. The inner shroud 302 may include a body 308, a first end portion 310 and a second end portion 312. In certain embodiments of the invention, the body 308 may be an arcuate structure or include one or more arcuate portions and/or surfaces. The inner shroud 302 may further include a first mounting means 314*a* and a second mounting means 314*b* located at the first end portion 310 and the second end portion 312 respectively. The first and second mounting means may be and/or include any suitable mounting mechanisms and/or mounting devices that facilitate the connection of the inner shroud 302 to the outer shroud 304. For example, the mounting means 314*a*, 314*b* may include hook portions that are operable to engage or removably connect with corresponding lower hooks 316*a*, 316*b* associated with the outer shroud. Other types of suitable mounting means may include, but are not limited to, other types of hooks, bolts, snaps, screws, etc. The outer shroud 304 may further include a plurality of mounting portions, such as mounting portions 318*a* and 318*b*, that facilitate mounting the outer shroud 304 to a turbine casing, such as casing 200 illustrated in FIG. 2. The mounting portions 318*a* and 318*b* may facilitate the removable attachment of the outer shroud 304 to the turbine casing 200 via one or more hooks (not shown) provided on the turbine casing 200. The outer shroud 304 may additionally include one or more cooling holes (not shown) that facilitate the circulation of a cooling fluid in order to maintain the temperature of the outer shroud 304 within a predefined range. The cooling fluid may be cooling air or any other type of cooling gas or coolant.

The outer shroud 304 may be manufactured by, for example, a forging process. The inner shroud 302 may be manufactured by, for example, a forging process and/or by an investment casting process. In one embodiment, the inner shroud 302 may be made from a nickel alloy with a majority or largest constituent of nickel (containing approximately 50% or more nickel); however, in other embodiments of the invention, an inner shroud 302 may be made or constructed from a wide variety of different metals, alloys, composites, and/or other materials in purity or in combination.

FIG. 4 is a schematic perspective view of a conventional inner shroud 400 for use in a turbine shroud assembly. For example, the inner shroud 400 illustrated in FIG. 4 may be utilized in the shroud assembly shown in FIG. 3. With reference to FIG. 4, the inner shroud 400 may include an upper surface 402, a lower surface 404, a first end portion 420, and/or a second end portion 425. Two end rails 406*a*, 406*b* and a central rail 408 may extend from the first end portion 420 to the second end portion 425. Within a gas turbine, such as turbine 100 illustrated in FIG. 1, the lower surface 404 of the inner shroud 400 may be placed or situated adjacent to a plurality of rotating turbine blades, such as blades 204 illustrated in FIG. 2. In this regard, the inner shroud 400 may form or define a hot gas path for the one or more hot gases coming from a plurality of nozzles, such as first stage nozzles 202 illustrated in FIG. 2. The two end rails 406*a*, 406*b*, and the central rail 408 may provide a structural stiffness to the inner shroud 400. Additionally, the two end rails 406*a*, 406*b* and the central rail 408 may define an impingement cooling area 410 along the upper surface 402 of the inner shroud 400 to accommodate an impingement cooling plate, such as impingement cooling plate 306 shown in FIG. 3. A cooling gas may strike the impingement cooling plate 306 in order to cool the inner shroud 302 and keep the temperature within a predefined range. Cooling holes (not shown in figure) may also be provided in the inner shroud 400 to provide or facilitate an effective and efficient cooling of an associated shroud assembly, such as the shroud assembly 214 shown in FIG. 2.

FIG. 5 is a cross-sectional view taken along reference line A-A' of the conventional inner shroud 400 shown in FIG. 4. FIG. 5 further illustrates respective rail thicknesses RT1 and RT2 of the two end rails 406*a* and 406*b* respectively, a central rail thickness CT of the center rail 408, and a bath tub thickness BT of a base 502 of the impingement cooling area 410. The bottom of the bath tub base 502 may be curved and therefore, may provide an arcuate shape or arcuate structure to the inner shroud 400. The rail thicknesses RT1 and RT2, the central rail thickness CT and the bath tub thickness BT may be three of the major parameters that govern the modal vibration frequencies of the inner shroud 400. The range of values utilized for the rail thicknesses RT1, RT2, the central rail thickness CT, and/or the bathtub thickness BT may depend on a variety of parameters and/or characteristics, such as, application and stiffness requirements for the inner shroud 400. In accordance with various operating conditions, sizes and applications of a gas turbine, such as gas turbine 100 illustrated in FIG. 1, the range of values for the rail thicknesses RT1, RT2, the central rail thickness CT, and/or the bathtub thickness BT may vary as desired. Traditionally, a modal analysis of the inner shroud 400 may be considered when designing the inner shroud and/or the turbine 100, as the modal analysis may facilitate the determination of one or more vibration frequencies associated with the inner shroud 400. For the inner shroud 400 depicted in FIG. 4, the modal vibration frequencies of the inner shroud 400 obtained from one example of a modal analysis are provided in Table 1 below.

TABLE 1

| Mode | Modal Frequency (Hz) |
|---|---|
| 1 | 876.5 |
| 2 | 1444.1 |
| 3 | 3050.6 |
| 4 | 3495.1 |
| 5 | 4534.8 |
| 6 | 4776.1 |
| 7 | 5675.5 |
| 8 | 6310.8 |
| 9 | 6914.2 |
| 10 | 6978.1 |

FIG. 6 is a Campbell Diagram 600 for the conventional inner shroud 400 shown in FIG. 4. The Campbell diagram 600 illustrates the coincidence of a resonance between the modal vibration frequencies of the inner shroud 400 and the excitation frequencies of first stage rotating turbine blades of a turbine utilizing the inner shroud 400, such as the first plurality of rotating turbine blades 204 illustrated in FIG. 2. In the Campbell diagram, the horizontal axis may denote an operating range for revolutions per minute (rpm) for the rotor of a gas turbine, such as turbine 100 illustrated in FIG. 1, and the vertical axis may denote the excitation frequencies of the first plurality of rotating turbine blades 204. The modal vibration frequencies of the inner shroud are plotted on a right side vertical axis. In the gas turbine 100, the plurality of rotating turbine blades 204 in the first expansion stage may include any number of blades, such as 92 blades. In a rotor operating range of approximately 3600 rpm, the excitation frequency of the first plurality of rotating turbine blades 204 may lie close to the $7^{th}$ modal vibration frequency of the inner shroud 400. Such a condition may result in resonance or modal excitations in the inner shroud 400. This resonance may contribute to or lead to the cracking of a seal, such as a cloth or a honeycomb seal, between the inner shroud 400 and the first plurality of rotating turbine blades. This may lead to a leakage of the hot gases to a secondary flow path, which reduces the efficiency of the gas turbine 100. Besides, hot gas path (HGP) ingestion may occur and reduce the cooling to an associated outer shroud, such as outer shroud 304 illustrated in FIG. 3. Due to this reduction in cooling, the temperature associated with the outer shroud 304 may increase, contributing to or leading to structural damage to the outer shroud 304. Thus, the leakage of the hot gases may reduce the life cycle of a turbine shroud assembly, such as shroud assembly 214, may increase the maintenance and repair cost of the shroud assembly 214, and may adversely affect the performance of the gas turbine 100.

The foregoing description of FIG. 4-6 relates to one embodiment of a gas turbine 100 and a conventional inner shroud 400 that may be utilized in association with the gas turbine 100. Different gas turbines or other types of turbines may be utilized in other embodiments of the inventions. These different turbines may include different components and/or operating characteristics. For example, different turbines may include any number of blades within an expansion stage. As another example, different turbines may have different operating ranges (e.g. rpm) for a rotor and, in turn, these different operating ranges may lead to different excitation frequencies that are taken into account.

In the foregoing description of FIGS. 4-6, the inner shroud 400 has been described in detail along with some problems encountered with the inner shroud 400. To alleviate the problems described thus far, various embodiments of the invention are described in FIGS. 7-10. For certain embodiments of the invention described below, several design modifications were considered and experimentally tried, with improved results in increasing the gap between the concerned modal frequency of an inner shroud and the blade vibration frequency in the operational range of a turbine.

FIG. 7 shows a schematic perspective view of an inner shroud 700 in accordance with an embodiment of the invention. The inner shroud 700 may include a body 702, an upper surface 704, a lower surface 706, a first end portion 708, and a second end portion 710 opposite to the first end portion 710. The inner shroud 700 may further include two end rails 712*a*, 712*b* and a central rail 714 extending from the first end portion 708 to the second end portion 710. In use, the lower surface 706 may be placed adjacent to a plurality of rotating turbine blades, such as the first plurality of rotating turbine blades 204 illustrated in FIG. 2, and the lower surface 706 may form or define a hot gas path for the hot gases coming from a plurality of associated first stage nozzles, such as nozzles 202 shown in FIG. 2. The two end rails 712*a*, 712*b* and the central rail 714 may provide structural stiffness to the inner shroud 700. Additionally, the inner shroud 700 may be an arcuate structure or alternatively, may include one or more arcuate portions and/or surfaces. In one embodiment, the two end rails 712*a*, 712*b* and the central rail 714 may define an impingement cooling area 716 along the upper surface 704 to accommodate an impingement cooling plate, such as impingement cooling plate 306 shown in FIG. 3.

Additionally, in accordance with an aspect of the invention, the inner shroud 700 may include a cross-member 718 formed on and/or connected to the upper surface. For example, the cross-member 718 may be a protruded shape placed on or formed on the upper surface 704 of the inner shroud 700. The cross-member 718 may be provided in a direction transverse to the two end rails 712*a*, 712*b* and the central rail 714, and the cross-member may divide and/or bisect the impingement cooling area 716 into two parts.

In one embodiment of the invention, the inner shroud 700 may be constructed of a nickel alloy (of at least approximately 50% of nickel) using an investment casting process. Additionally, the inner shroud 700 may include mounting means 720*a* and 720*b* provided at the first end portion 710 and the second end portion 712 respectively. The mounting means 720*a* and 720*b* may be and/or include any appropriate mounting mechanisms and/or devices that facilitate the mounting of the inner shroud 700 to an outer shroud of a gas turbine, such as outer shroud 304 show in FIG. 3. The mounting means 720*a* and 720*b* may be similar to the mounting means 314*a* and 314*b* illustrated and described above with reference to FIG. 3.

In various other embodiments of the invention, the dimensions of the cross-member 718 may be varied. For example, the dimensions of the cross-member may be determined based at least in part on various factors of the gas turbine 100, for example, the normal operating range (in rpm) for the rotor of the gas turbine 100, the number of blades in a expansion stage of the gas turbine 100, the material of the inner shroud 700, etc. In one embodiment, the cross-member 718 may have a length of approximately 0.446 inch (1.32 cm) extending in a direction transverse to the two end rails 712*a*, 712*b* and a width of approximately 0.145 inch (0.37 cm).

In various embodiments of the invention, providing at least one cross-member 718 on the upper surface 704 of an inner shroud 700 may facilitate the modification of the modal vibration frequencies of the inner shroud 700 and may assist in avoiding a resonance or modal excitation of the inner shroud 700. In one embodiment, a plurality of inner shrouds 700 may be utilize in a shroud assembly of a gas turbine 100, such as shroud assembly 214 shown in FIG. 2. The at least one cross-member 718 of each of the plurality of inner shrouds 700 may facilitate the shifting of the $7^{th}$ modal vibration frequency of each of the plurality of inner shrouds 700 away from an excitation frequency of a plurality of rotating turbine blades, such as the first plurality of rotating turbine blades 204 illustrated in FIG. 2. The gas turbine 100 utilizing the plurality of inner shrouds 700 may also utilize a plurality of other inner shroud designs as desired in various embodiments of the invention. A few examples of additional inner shroud designs that may be utilized are described herein.

In accordance with an aspect of the invention, the inner shroud 700 may shift at least one modal vibration frequency of one or more of the plurality of inner shrouds 700 away from an excitation frequency of a plurality of rotating turbine blades associated with an expansion stage of a gas turbine. For example, in one embodiment at least one modal vibration frequency of an inner shroud may be shifted approximately ±10% away from an excitation frequency of a plurality of rotating turbine blades of a gas turbine 100. In other embodiments, at least one modal vibration frequency of an inner shroud may be shifted as desired any other amount or percentage away from an excitation frequency associated with the gas turbine 100, such as, ±5%, ±7%, ±15%, etc.

When utilized in a gas turbine having a rotor operating at 3600 rpm, the modal vibration frequencies for the inner shroud 700 are found to be shifted sufficiently away from the excitation frequency of a plurality of rotating blades. For example, the $7^{th}$ modal vibration of the inner shroud 700 is shifted away from the excitation vibration frequency of the first plurality of rotating blades 204 of the turbine 100 illustrated in FIGS. 1 and 2. One example of a depiction of the modal vibration frequencies of the inner shroud 700 obtained from a modal analysis is provided in Table 2 below.

TABLE 2

| Mode | Modal Frequency (Hz) |
|---|---|
| 1 | 870.0 |
| 2 | 1418.40 |
| 3 | 3002.1 |
| 4 | 3418.1 |
| 5 | 4531.4 |
| 6 | 4787.0 |
| 7 | 5924.2 |
| 8 | 6830.7 |
| 9 | 6958.6 |
| 10 | 7040.2 |

Though the embodiment of FIG. 7 is described using two end rails and a central rail along with a cross-member, an embodiment comprising two end rails with at least one cross-member falls within the spirit and scope of the invention.

FIG. 8A is a perspective view of another example of an inner shroud 800*a* in accordance with an illustrative embodiment of the invention. With reference to FIG. 8A an inner shroud 800*a* is shown with two cross-members 802*a* and 802*b* placed on an upper surface 804 of the inner shroud 800*a*. The two cross-members 802*a* and 802*b* may be protruded shapes in a direction transverse to the two end rails 806*a* and 806*b*.

FIG. 8B is a perspective view of another example of an inner shroud 800*b* in accordance with an illustrative embodiment of the invention. With reference to FIG. 8*b*, an inner shroud 800*b* is shown with three cross-members 808*a*, 808*b* and 808*c* placed on an upper surface 810 of the inner shroud 800*b*. The three cross-members 808*a*, 808*b* and 808*c* may be protruded shapes in a direction transverse to the two end rails 812*a* and 812*b* of the inner shroud 800*b*. In various embodiments, under different operating conditions depending on the application and size of a gas turbine, either the inner shroud 800*a* or 800*b* may modify at least one modal vibration frequency of respective inner shrouds and avoid modal excitation or resonance of the inner shrouds due to the excitation frequency of the plurality of rotating turbine blades.

Additionally, in various embodiments of the invention, one or more cross-members may extend along the upper surface in many different directions. For example, one or more cross-members may extend between the two end rails in or more directions that are not transverse to the two end rails, such as, in one or more diagonal directions and/or in one or more arcuate directions relative to one or more of the two end rails.

FIG. 9 illustrates examples of various types of ribs that may be utilized as cross-members in an inner shroud, according to various illustrative embodiments of the invention. FIG. 9 illustrates alternate cross-member designs that can be employed in the gas turbines to modifying one or more modal vibration frequencies of an inner shroud, such as inner shroud 700 shown in FIG. 7. Cross-member designs in accordance with various embodiments of the invention may include a substantially circular rib 900, substantially rectangular ribs 902*a* and 902*b*, a substantially oval rib 904 and/or a substantial semicircular rib 906. Other rib shapes and sizes may be utilize as desired to achieve similar results of modifying the inner shroud modal vibration frequencies in a manner which agrees with relevant design goals and/or requirements, such as, shifting the modal vibration frequencies sufficiently away from the turbine blade excitation frequency.

FIG. 10 is one example of a Campbell Diagram for the inner shroud 700 of FIG. 7, according to an illustrative embodiment of the invention. The Campbell diagram 1000 shows the coincidence of a resonance between the excitation frequency of a plurality of rotating turbine blades, such as the first plurality of rotating turbine blades 204 show in FIG. 2, and the modal vibration frequencies of the inner shroud 700. In one embodiment, in an operating range of about 3600 rpm for the rotor, the excitation frequency of the first plurality of rotating turbine blades 204 may lie or fall sufficiently away from the $7^{th}$ modal vibration frequency of the inner shroud 700. By utilizing the inner shroud 700, the resonance or modal excitations in the inner shroud 700 may be reduced and/or avoided in a shroud assembly of the gas turbine, such as shroud assembly 214 shown in FIG. 2. The efficiency of the gas turbine, such as turbine 100 shown in FIG. 1, and the life cycle of the shroud assembly 214 may be increased and the overall performance of the gas turbine 100 may be improved.

FIG. 11 is a flowchart of one example of a method 1100 for making, producing, and/or manufacturing an inner shroud, according to an illustrative embodiment of the invention. The method 1100 may additionally be a method for modifying at least one modal vibration frequency of an inner shroud, such as inner shroud 700 shown in FIG. 7, of a shroud assembly in a gas turbine. The method may begin at block 1102.

At block 1102, a body of the inner shroud 700 may be provided. The body may include a first end portion and a second end portion. Additionally, in some embodiments, the body may provide an arcuate structure to the inner shroud 700. Once the body has been provided, operations may continue at block 1104.

At block 1104, at least two rails and may be provided that extend between the first end portion and the second end portion of the inner shroud 100. Once the at least two rails have been provided, operations may continue at block 1106 and at least one cross-member may be provided on the upper surface. The at least one cross-member may be formed or provide on the upper surface in a direction transverse to the at least two rails. Additionally, in some embodiments, the at least one cross-member may include a protruded shape that is formed in a direction transverse to the at least two rails. Additionally, in certain embodiments, the at least one cross-member provided on the upper surface may have various designs and dimensions, such as those designs and dimensions illustrated in FIG. 9. The provided at least one cross-member may facilitate the modification of one or more frequencies associated with the inner shroud 700. For example, the at least one cross-member may facilitate the shifting of at least one modal frequencies of the inner shroud 700 away from an excitation frequency associated with a corresponding plurality of rotating turbine blades within a turbine.

The method 1100 may end following block 1106.

The operations described in the method 1100 of FIG. 11 do not necessarily have to be performed in the order set forth in FIG. 11, but instead may be performed in any suitable order. Additionally, in certain embodiments of the invention, more or less than all of the operations set forth in FIG. 11 may be performed.

A wide variety of different type and shapes of cross-members may be utilized as desired in various embodiments of the invention. The utilized cross-members may facilitate the modification of the inner shroud's harmonic and other modal frequencies in such a way such that each of the frequencies fall outside an undesired zone around a turbine rotor blade excitation frequency, such as, outside of a zone of within ±10% of the turbine rotor blade excitation frequency. Excitation in the turbine rotor blades may be caused due to the rotation of the turbine rotor, onto which the blades are fixed, and may be unavoidable.

While the invention has been described in connection with what is presently considered to be the most practical and various embodiments, it is to be understood that the invention is not to be limited to the disclosed embodiments, but on the contrary, is intended to cover various modifications and equivalent arrangements included within the spirit and scope of the appended claims.

This written description uses examples to disclose the invention, including the best mode, and also to enable any person skilled in the art to practice the invention, including making and using any devices or systems and performing any incorporated methods. The patentable scope the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

determining an excitation frequency of a plurality of rotating turbine blades;

determining a modal vibration frequency of an inner shroud, the inner shroud comprising:

a body having a first end portion, a second end portion, an upper surface, and a lower surface, wherein the lower surface is adjacent to the plurality of rotating turbine blades; and at least two rails extending between the first end portion and the second end portion along a length of the body, wherein the at least two rails define an impingement cooling area on the upper surface and between the at least two rails; and modifying the modal vibration frequency of the inner shroud with at least one cross-member disposed on the upper surface in a direction transverse to the at least two rails, the at least one cross-member dimensioned to shift the modal vibration frequency of the inner shroud away from the excitation frequency of the plurality of rotating turbine blades.

2. The method of claim 1, wherein the at least one cross-member comprises a plurality of cross-members.

3. The method of claim 1, wherein the at least one cross-member comprises a protruded shape on the upper surface of the inner shroud.

4. The method of claim 1, wherein the at least one cross-member divides the impingement cooling area into two parts.

5. The method of claim 1, wherein the body of the inner shroud comprises a body with an arcuate structure.

6. The method of claim 1, wherein the inner shroud comprises an inner shroud constructed from at least one nickel alloy.

7. The method of claim 1, wherein the first end portion and the second end portion further comprise one or more respective mountings that facilitate connecting the inner shroud to the outer shroud.

8. The method of claim 1, wherein the at least two rails define an impingement cooling area, and wherein the at least one cross-member bisects the upper surface of the inner shroud and divides the impingement cooling area into two parts.

* * * * *